US008147156B2

(12) United States Patent
Ward

(10) Patent No.: US 8,147,156 B2
(45) Date of Patent: Apr. 3, 2012

(54) TAG MAKING AND STACKING SYSTEMS AND METHOD, TAG STACKERS AND STACK TRAYS

(75) Inventor: Donald J. Ward, Sayre, PA (US)

(73) Assignee: Avery Dennison Corporation, Pasadena, CA (US)

( * ) Notice: Subject to any disclaimer, the term of this patent is extended or adjusted under 35 U.S.C. 154(b) by 611 days.

(21) Appl. No.: 12/357,452

(22) Filed: Jan. 22, 2009

(65) Prior Publication Data

US 2010/0129130 A1 May 27, 2010

Related U.S. Application Data

(63) Continuation-in-part of application No. 12/277,581, filed on Nov. 25, 2008.

(51) Int. Cl.
*B41J 11/00* (2006.01)

(52) U.S. Cl. ..... 400/621

(58) Field of Classification Search ..... 400/608.2, 400/608.4, 613, 614, 621, 621.1, 621.2
See application file for complete search history.

(56) References Cited

U.S. PATENT DOCUMENTS

| | | | | |
|---|---|---|---|---|
| 5,092,697 | A | 3/1992 | McKenna | |
| 7,125,182 | B2 | 10/2006 | Campbell et al. | |
| 7,497,401 | B2 * | 3/2009 | Blanchard et al. | 242/598.2 |
| 7,618,204 | B2 * | 11/2009 | Blanchard et al. | 400/618 |
| 2005/0180796 | A1 * | 8/2005 | Blanchard et al. | 400/613 |
| 2007/0248396 | A1 | 10/2007 | Blanchard, Jr. et al. | |

OTHER PUBLICATIONS

Printer Systems Rewind/Slitter Operating Instructions Manual; Cover page and pp. ii and 1:1 through 1:6, 1990.

* cited by examiner

*Primary Examiner* — Seung Lee
(74) *Attorney, Agent, or Firm* — Avery Dennison Corporation

(57) ABSTRACT

There is disclosed a tag making and stacking system, tag stackers and stack trays. To increase tag making capacity, a wide tag web is slit into completely severed narrow tag webs which are cut apart to form tags which are immediately separated and formed into spaced apart stacks. The new system includes a printer and a stacking system to receive and stack tags. The stacking system includes a tag stacker and a removable tag-receiving tray to facilitate transferring a stack of tags from the tag stacker to the place where the tags are to be used. A method of handling tags involves the provision of at least first and second removable trays wherein a first tray with a stack of tags can be replaced by an empty second tray so that the stacking of additional tags can recommence without waiting for the first tray to be emptied.

18 Claims, 18 Drawing Sheets

TAG MAKING AND STACKING SYSTEMS AND METHOD, TAG STACKERS AND STACK TRAYS

CROSS-REFERENCE TO RELATED PATENT DOCUMENTS

This application is a Continuation-In-Part of co-pending patent application Ser. No. 12/277,581, filed Nov. 25, 2008.

U.S. Pat. No. 7,125,182 and U.S. patent application Ser. No. 11/409,803 are incorporated herein by reference in their entireties.

BACKGROUND

1. Field

The field to tag making and stacking systems and method, tag stackers, and stack trays.

2. Brief Description of the Prior Art

The following U.S. patent documents are made of record: U.S. Pat. Nos. 5,092,697; 7,125,182; U.S. patent application Ser. No. 11/409,803; and Printer Systems Revised Slitter Operation Instructions Manual, Cover page and pages ii and 1:1 through 1:6.

SUMMARY

An embodiment relates to an improved stacking system for a printer and to trays for stacks of tags. As the printer operates, tags can accumulate in a removable tray in the stacker. When the desired number of tags has accumulated in the tray, the printer can be stopped or interrupted and the tray can be removed. An empty tray can be inserted into the stacker and the printer can resume printing. In the meantime, the tray containing the accumulated stack of tags can be taken to a location where the tags are to be used, and so on. It is clear that by use of one or more trays the overall output of the printer can be increased.

An embodiment of a method of handling tags, comprises providing at least first and second removable trays insertable and positionable in a tag stacker, inserting the first tray in the tag stacker, feeding tags into the first tray in the tag stacker, interrupting the feeding of tags, removing the first tray from the tag stacker, inserting and positioning the second tray in the tag stacker, and feeding tags into the second tray in the tag stacker. The method can start out by providing a roll of a printable web, printing on the web on one or both sides of the web, and severing the web into separate tags. Alternatively, printed tags can be provided in the form of a roll of a tag web and the tags can be severed from the tag web.

An embodiment of the disclosure includes a stacking system comprising a stacker having a platform, a tray removably supported on the stacker, the tray including an upstanding rear panel and a bottom panel connected to the rear panel, the bottom panel being capable of being supported on the platform, the bottom panel being capable of accumulating a stack of tags, wherein the tray can include a side panel toward which the tags can be fed, wherein the side panel is spaced from a side wall of the stacker, wherein the side panel can be adjustably positionable and attached to the rear panel, and the side panel is manually movable toward and away from the side wall, and wherein the side panel can be magnetically attached to the rear panel. A tag hold-down device can be repositionably attached to one or both of the side and rear panels. The tag hold-down device is preferably magnetically attached to one or both of the side and rear panels.

The embodiment of the stacking system comprises a stacker having a side panel toward which tags can be fed, the side panel being magnetically attached and repositionable to accommodate tags of different lengths.

The embodiment of a stack tray comprises a rear panel, a bottom panel connected to the rear panel, the bottom panel being capable for supporting a stack of tags, a side panel selectively repositionable with respect to the rear panel, wherein the rear panel is comprised of magnetically responsive material, and a magnet on the side panel enabling the side panel to be magnetically attached to the rear panel at a selected position. A hold-down device can be magnetically attached to one or both of the side and rear panels to retain the stack of tags between the bottom panel and the hold-down device.

The disclosure includes a system and method for creating a plurality of stacks of tags. Starting from a web roll of a wide tag stock web which may be pre-printed with certain fixed information such as a logo, the wide web can be printed on one or both sides with variable information. The printing can be repetitive across the width of the wide web at two or more locations. Thereafter, the wide web can be slit between the locations to provide side-by-side narrow tag webs. The narrow tag webs can be cut laterally to provide side-by-side tags. The tags can be separated laterally and allowed to descend gravitationally to form two separate upstanding tag stacks. The stacks are supported so that the tags in each stock are inclined or lean away from each other.

According to an embodiment, there is disclosed a combination system and a method which includes printing on an uncut double-wide web, slitting the double-wide web into single-wide or narrow webs, cutting tags successively from the narrow webs and stacking the tags in separate stacks. This increases the through-put of the system while conveniently stacking the tags for ease of further handling. The tags stack are preferably spaced from each other. To achieve the spacing, a tag separator is used. The tag stacks accumulate on a support structure that inclines the tags away from each other. The inclined tags of each stack are confined by side guides or stops. All the functions of printing, slitting, cutting, feeding and stacking are disclosed as being accomplished in-line, that is, in a single apparatus.

According to an embodiment, a tag making and stacking system can include at least one print head capable of printing repetitively across at least one face of a wide tag web, a slitter disposed downstream of the print head(s) and capable of slitting the wide tag web into two separate side-by-side narrow tag webs, a first feed roll disposed downstream of the slitter, a cutter disposed downstream of the first feed roll to sever side-by-side tags from the narrow webs, a stacker, and a second feed roll disposed downstream of the cutter to feed the severed tags into side-by-side stacks in the stacker. The system can further include any one or more or all of: a motor-driven unwind for a supply roll of the wide tag web disposed upstream of the print head(s) to maintain web tension, a motor-driven platen roll cooperable with each print head, a tray removable supported on the stacker to accumulate and maintain the tag stacks until after the tray is removed, wherein the stacker is capable of accumulating stacks of tags having various widths, a platform capable of being lowered and raised, repositionable front and rear walls extending upwardly from the platform and capable of straddling stacks of different width tags, a separator capable of separating the tags into two spaced apart stacks as the tags enter the stacker, the separator including a separator bar which causes the side-by-side tags to be cammed apart as they advance into the stacker, where the separator bar can be generally aligned with the slitter to separate the tags as they enter the stacker and descend onto the tags of their respective stacks to provide separated stacks, and/or a bottom support for each stack that inclines the tags in each stack away from the tags of the adjacent stack.

An embodiment of a tag making and stacking system can include at least one print head capable of printing repetitively across at least one face of a wide tag web, a slitter disposed downstream of the print head(s) and capable of slitting the wide web into a pair of separate side-by-side narrow tag webs, a cutter disposed downstream of the slitter to sever side-by-side tags from the narrow webs, a stacker to receive the tags, and a separator to facilitate separation of the side-by-side tags into spaced stacks as they accumulate in the stacker.

An embodiment of a tag making and stacking system can include at least one print head capable of printing repetitively across at least one face of a wide tag web, a slitter disposed downstream of the print head(s) and capable of slitting the wide web into a pair of separate side-by-side narrow tag webs, a cutter disposed downstream of the slitter to sever side-by-side tags from the narrow webs, a stacker to receive the tags, and a bottom support for each stack that inclines the tags in each stack away from the tags of the adjacent stack. The system can also include a separator to facilitate separation of the side-by-side tags as they enter the stacker.

An embodiment can also include a print head capable of printing the same information laterally across a longitudinally extending wide web of tag stock on both sides of a longitudinal centerline of the wide tag web, a slitter capable of slitting the wide tag web along the centerline into a pair of completely severed narrow tag webs, a cutter capable of cutting the narrow tag webs laterally into side-by-side tags, and a separator to separate the side-by-side tags laterally while allowing the separated tags to descend gravitationally to form two spaced apart tag stacks and a support for each stack of tags, the supports being effective to cause the tags of both stacks to be inclined away from each other. The system can further include spaced walls providing a tag stack accumulating space, a support for each stack of tags, and the supports being oppositely inclined so that the stacks of tags are inclined away from each other and each stack is confined by one of the walls.

According to an embodiment, a stacker system can include a stacker having a platform including magnetizable material, a repositionable upstanding wall adjacent a tag stack accumulating space, the wall having a flange, and at least one magnet on the flange, wherein the magnet can be magnetically attracted to the platform to hold the upstanding wall in a desired position on the platform.

According to an embodiment, a stack tray for use in a tag stacker can include an upstanding rear panel, a bottom panel connected to the rear panel, and a repositionable upstanding front panel magnetically attached to the bottom panel, wherein the stacked tags are positionable between the front and rear panels.

According to an embodiment of a method can include printing the same information laterally across a longitudinally extending wide tag web of tag stock on both sides of a longitudinal centerline of the wide tag web, slitting the wide tag web along the centerline into a pair of completely severed narrow tag webs, cutting the narrow tag webs laterally into side-by-side tags, and separating the side-by-side tags laterally and allowing the separated tags to descend gravitationally to form two spaced apart tag stacks.

BRIEF DESCRIPTION OF THE DIAGRAMMATIC DRAWINGS

DETAILED DESCRIPTION OF THE PREFERRED EMBODIMENTS

Figure 1:
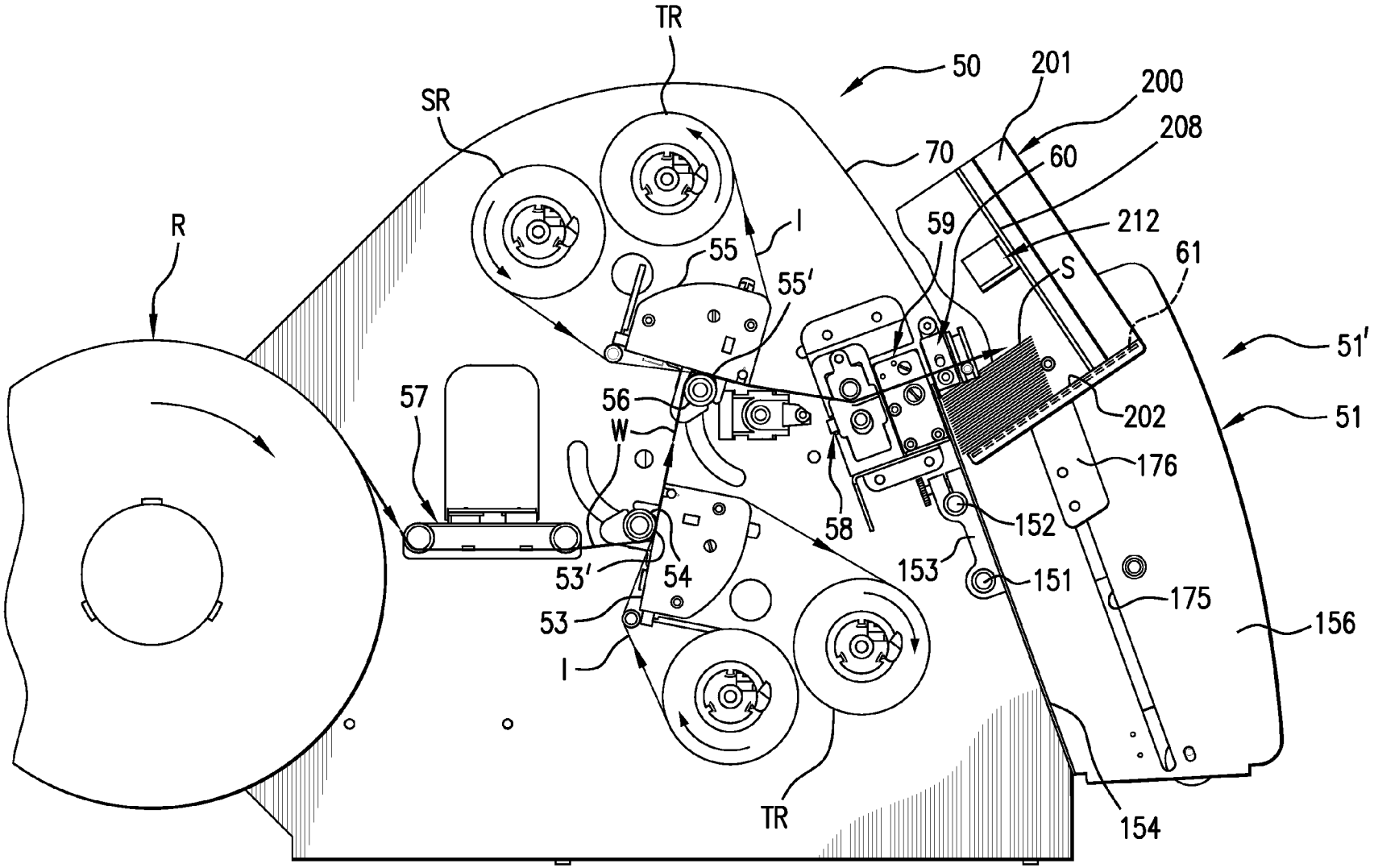
FIG. 1 is an elevational view of a printer and a stacking system including a stacker with a stack tray.

With reference to FIG. 1, there is illustrated a printer generally indicated at 50 for printing on a printable web W and a stacker generally indicated at 51. The printer 50 and the stacker 51 are disclosed in greater detail in U.S. Pat. No. 7,125,182. Where possible the same reference characters are used herein as in U.S. Pat. No. 7,125,182. Alternatively, the printer 50 can have components arranged differently as for example in U.S. application Ser. No. 11/409,803 wherein the path of travel of the web W is somewhat different. The web W is in the form of a roll R can pass beneath a guide mechanism 57. Then the web W can pass between a platen roll 54 and a print head 53' of a print head assembly 53 where the underside of the web W can be printed. From there the web can pass between a platen roll 56 and a print head 55' of a print head assembly 55 where the top side of the web W can be printed. The platen roll 56 may be a driven roll. From there the fully printed web W can pass to a feed mechanism 58 which can feed the web W to a cutter mechanism 59 which cuts the web W into predetermined length sheets, in particular tags T. The expression "tags"as used herein is intended to apply to paper and plastic tags, paper and fabric labels and other types of record members because all of such tags and labels can be handled by the printer 50 and the stacking system 51'. The tags T are fed to a feed mechanism 60 which feeds the tags T onto a platform 61 of the stacker 51. The feed mechanism 60 is close to the cutter mechanism 59 so that control of the cut-off tag T is maintained. The feed mechanism 60 can be considered to be part of the printer 50, because the feed mechanism 60 feeds the tags T out of the printer 50, or to be part of the stacker 51 because the feed mechanism 60 feeds the tag T onto the platform 61.

The printer 50 can be of the thermal transfer type wherein ink ribbon I can be advanced from a supply roll SR to a take-up roll TR for both print heads 53' and 55'.

The stacker 51 is mounted to a frame plate 70. Shafts 151 and 152 are cantilevered to the frame plate 70 and pass through a bracket 153 attached to a wall 154 which may be referred to as a side wall. By loosening a thumb screw 155, the stacker 51 can be adjusted laterally or transversely of the printer 50 toward and away from the plane of the frame plate 70.

The stacker 51 is illustrated as including the platform 61 which has a depending mounting member 176 secured to a slide (not shown) by screws 176' passing through a slot 175 in a rear wall 156. The platform 61 can be raised and lowered by a motor-driven pulley system (not shown). As the motor-driven feed roll 95 of the feed mechanism 60 feeds tags T into space within the stacker above the platform 61, the platform 61 is lowered.

Figure 4:
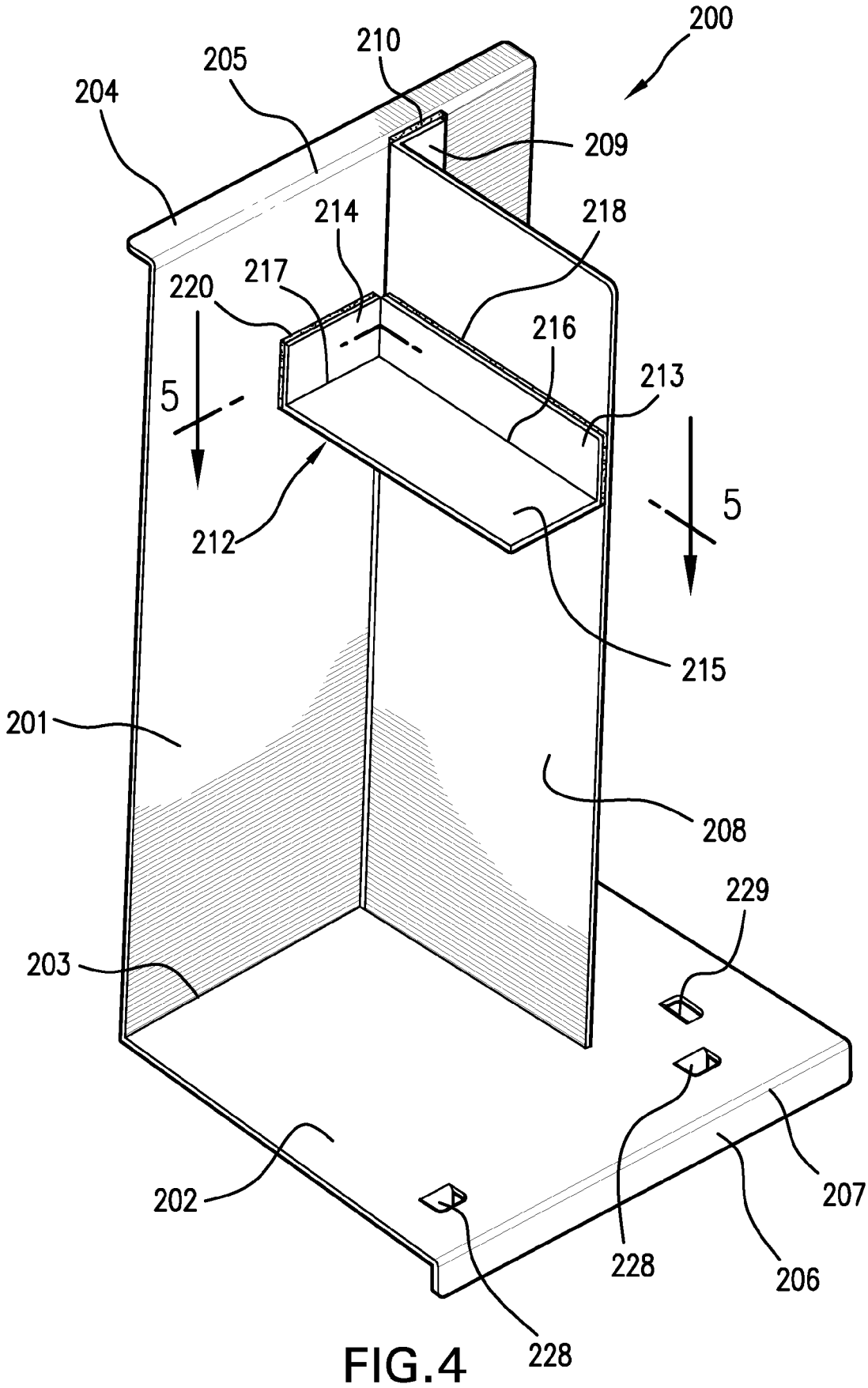
FIG. 4 is a pictorial view of the stack tray and a hold-down device also shown in FIGS. 1 and 2 for example.

With reference to FIG. 4, the stack tray generally indicated a 200 is shown to have an upstanding rear panel or wall 201 which is preferably formed integrally with a bottom panel or base panel 202. The rear and bottom panels 201 and 202 are preferably made by bending a piece of sheet metal at a bend line 203. The rear panel 201 preferably has a flange 204 made by bending the sheet metal along a bend line 205. The bottom panel preferably has a flange 206 made by bending the sheet metal along a bend line 207. The angle between the rear panel 201 and the bottom panel 202 is preferably a right angle. The rear panel 201 and the bottom panel are in an L-shaped configuration. Likewise, the angle of the flange 204 to the rear panel 201 is preferable a right angle, and the angle of the flange 206 to the bottom panel 202 is preferably a right angle. The flange 204 adds stiffness to the rear panel 201 and the flange 206 adds stiffness to the bottom panel 202.

The stacker 51 and the tray 200 form part of a stacker system 51'.

Figure 5:
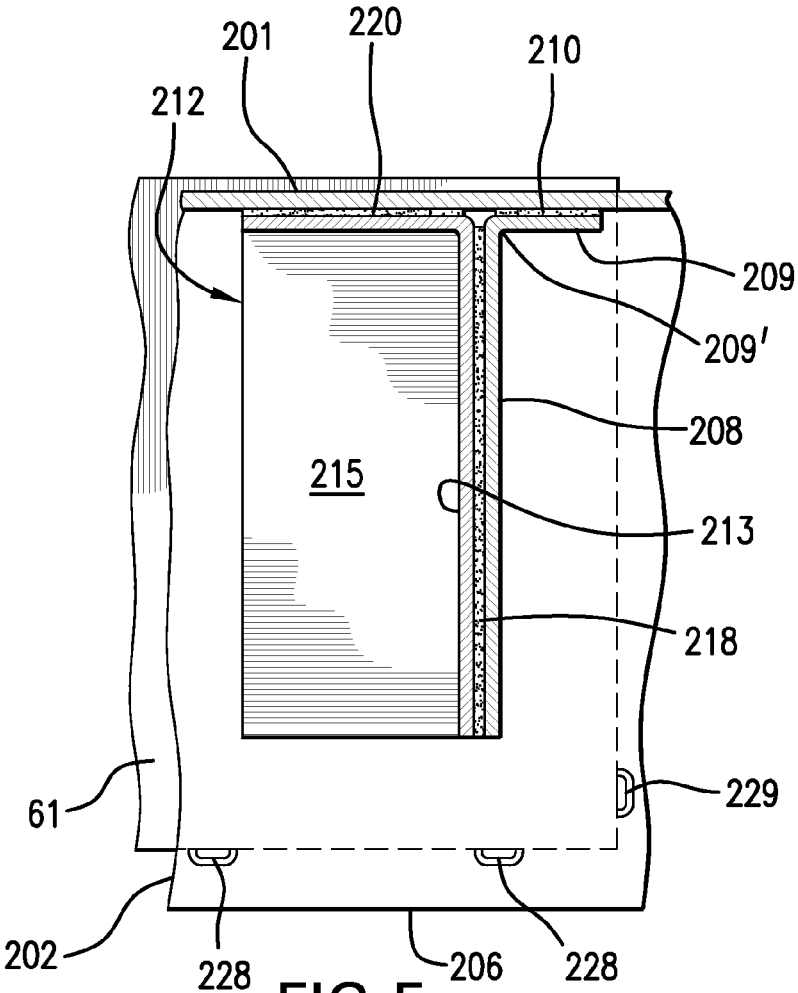
FIG. 5 is a sectional view taken along line 5-5 of FIG. 4.
Figure 7:
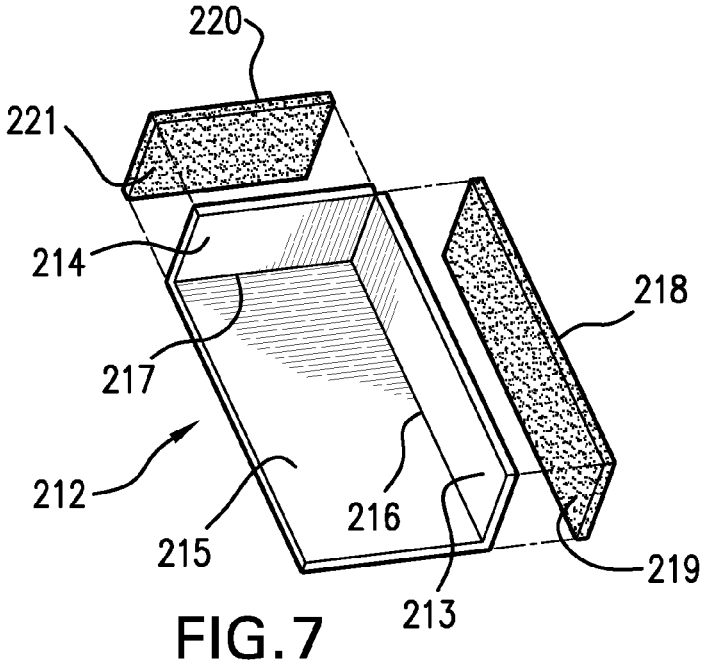
FIG. 7 is an exploded pictorial view of a hold-down device or member which can be positioned to bear against the top of the tag stack.
Figure 6:
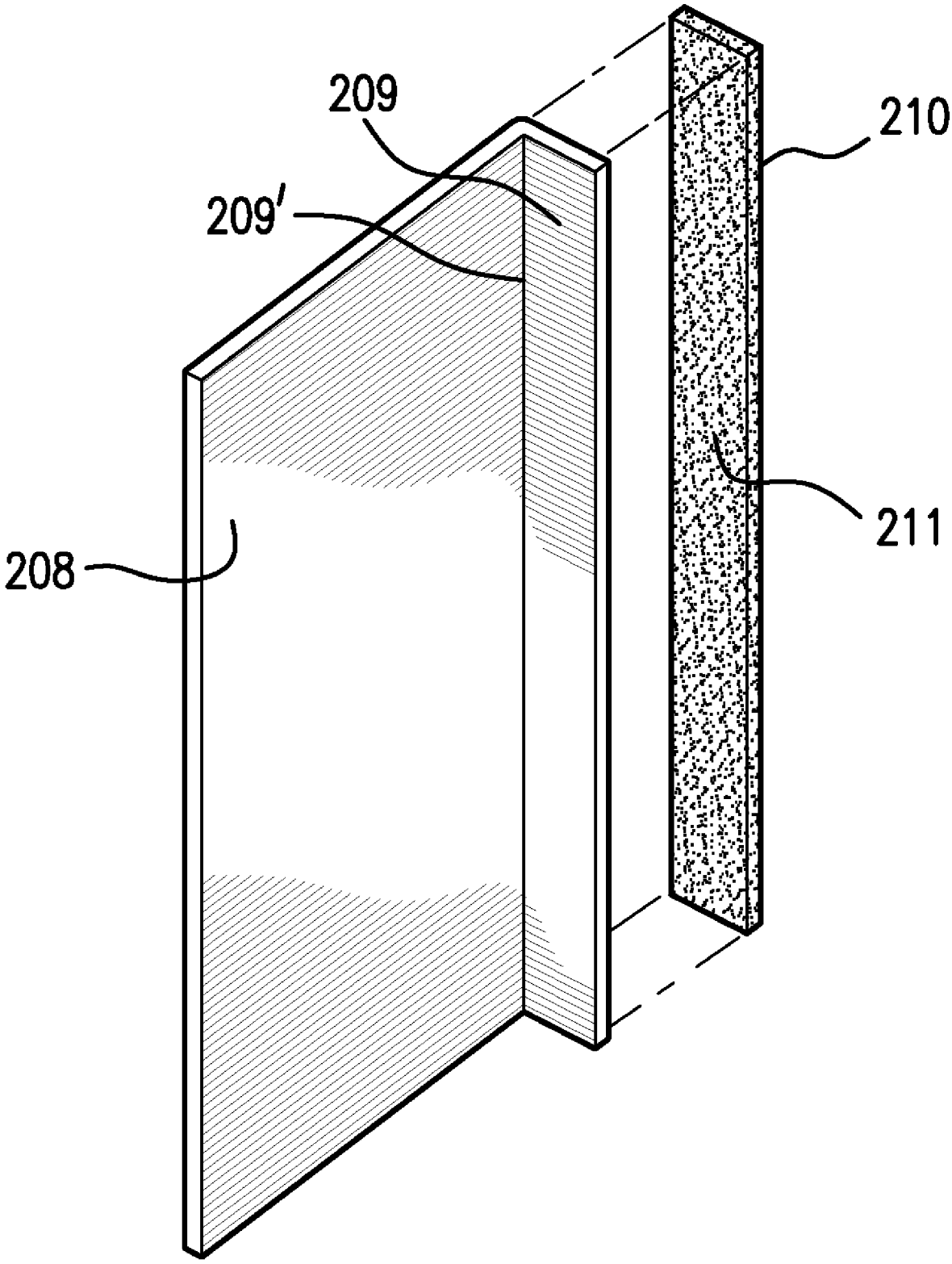
FIG. 6 is an exploded pictorial view of a panel which can form part of the stack tray.
Figure 8:
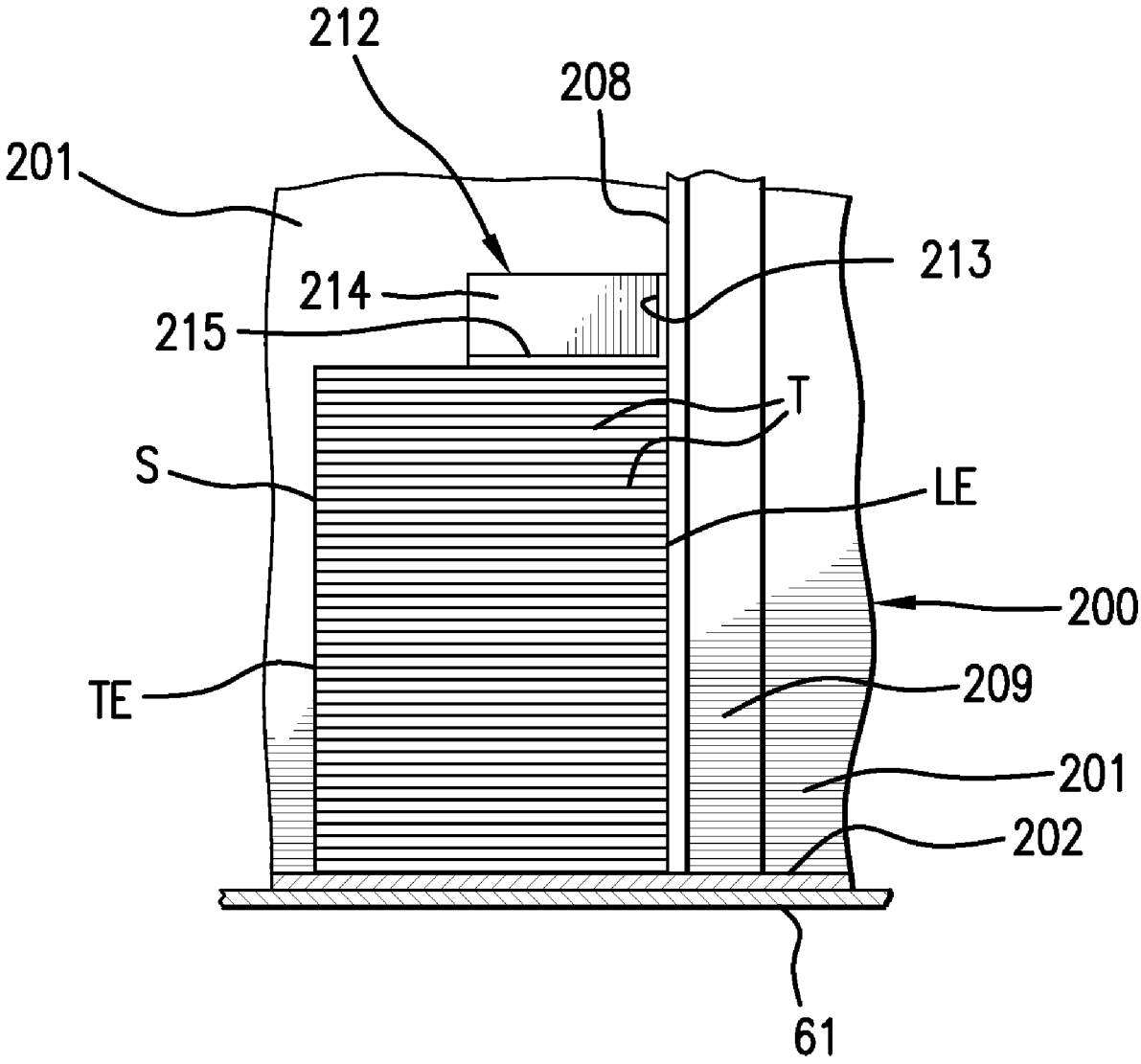
FIG. 8 is an elevational view showing a stack of tags on a bottom panel, when the tag stack is held or clamped between the bottom panel and the hold-down device.

An upstanding side panel or wall 208 preferably extends perpendicularly to the rear panel 201 and to the bottom panel 202. The side panel 208 has a flange 209 extending preferably at a right angle to the panel 208 from a bend line 209'. The side panel 208 is preferably perpendicular to the bottom panel 202. As best shown in FIGS. 5 and 6, a magnetic strip 210 is secured to the flange 209 preferably by an aggressive permanent adhesive 211. Even though the side panel 208 is preferably perpendicular to the bottom panel 202 and the rear panel 201, the side panel 208 can be magnetically attached to the rear panel at any selected angular orientation.

With reference to, for example, FIGS. 4, 5, 7 and 8, there is shown a hold-down device or member generally indicated at 212. The device 212 is shown to have a side panel 213 and a back panel 214 connected to a bottom panel 215 at respective fold lines 216 and 217. The side and rear panels 213 and 214 are preferably disposed at right angles to each other and to the bottom panel 202. The panels 213, 214 and 215 are preferably formed from one piece of sheet metal by bending up panels 213 and 214 with respect to the bottom panel 215. A magnet 218 preferably in the form of a magnetic strip is adhered to the outside of the side panel 213 by an aggressive permanent adhesive 219, and a magnet 220 preferably in the form of a magnetic strip is adhered to the outside of the rear panel 214 by an aggressive permanent adhesive 221. Instead of one magnet 218 for the side panel 213 and one magnet 220 for the rear panel 214, multiple spaced magnets or magnetic strips can be provided. The magnets 218 and 220 can, of course, be adhered to their respective panels by any other suitable means, such as by fasteners.

In use, the stack tray 200 can be simply seated or rested on the platform 61. Tags T can be dispensed toward the side panel 208 and accumulate on the bottom panel 202. As the tags T accumulate, the platform 61 can be lowered so that the tags T continue to be able to be deposited on the top of the stack S. It should be noted that it is not necessary that some or all of the tags T reach the side wall 208. When the desired number of tags has accumulated in a stack S which rests on the bottom panel 202, the stack tray 200 is ready to be removed. The user may lift the tray 200 out of the stacker 51 and tilt the tray 200 so that the tags T gravitate against the side panel 208. The user can actually assist by tamping on the trailing ends TE of the tags T to push the leading ends LE of the tags T against the side panel 208 to form a neater stack S. With the tags T vertically aligned, the user can manually slide the hold-down device 212 downwardly from the upper, normally out-of-use position shown in FIG. 1. In that the magnets 218 and 220 hold securely to the panels 213 and 214, the hold-down device 212 can be slid along the rear and side panels 201 and 208 without dislodging the magnets 218 and 220 from the remainder of the hold-down device 212. Accordingly, the hold-down device 212 can be slid down into contact with the top most tag T in the stack S. Preferably the hold-down device 212 is pressed against the stack S to slightly compress or clamp the stack S so that while the tray 200 and the stack S are transferred to the place where the tags T are to be used, the stack S is held firmly as a stack to eliminate the possibility of the stack S being dislodged or falling out of the tray 200.

Figure 2:
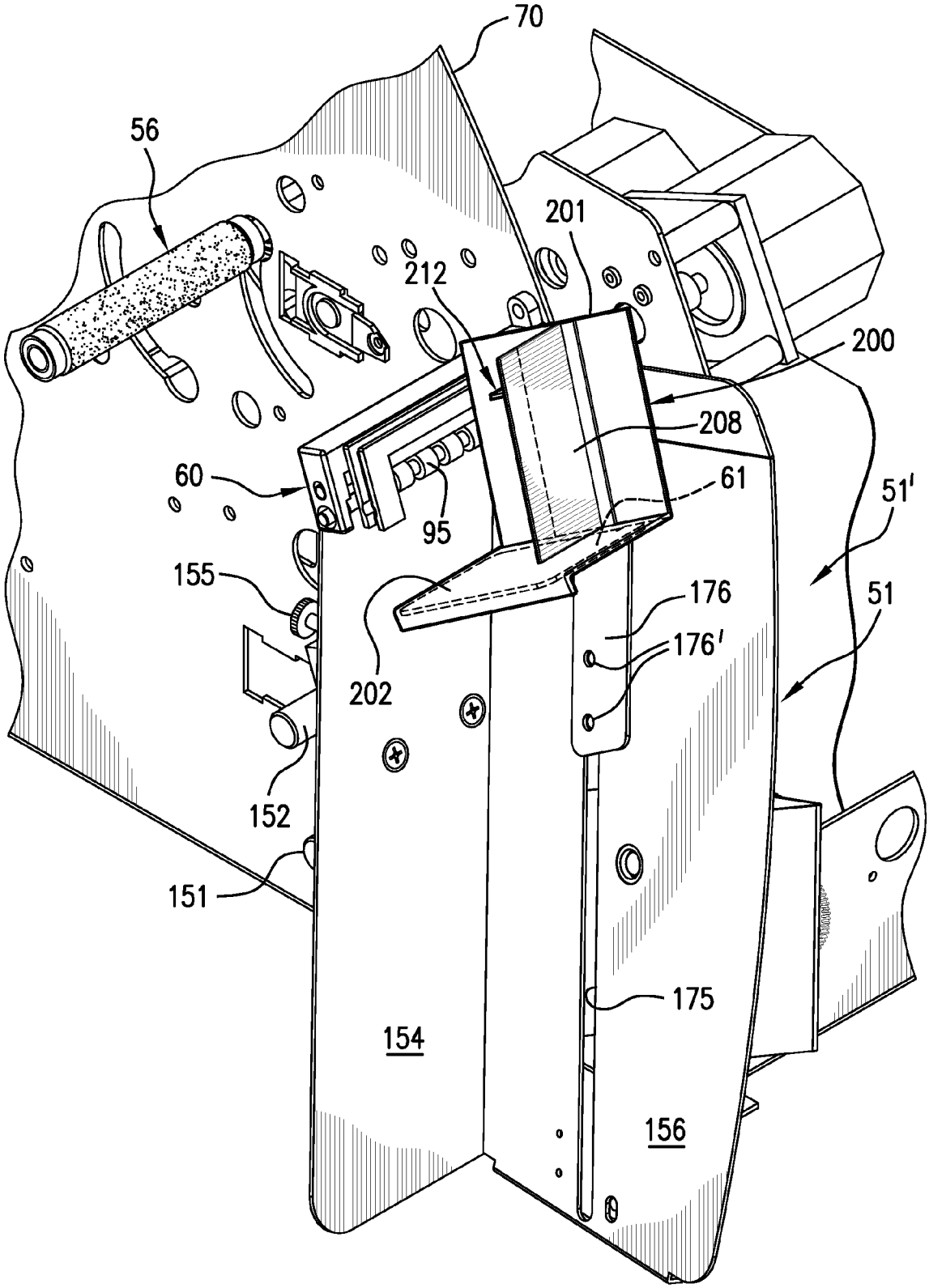
FIG. 2 is a pictorial view of a fragmentary portion of the printer and the tag stacker with the stack tray.
Figure 3:
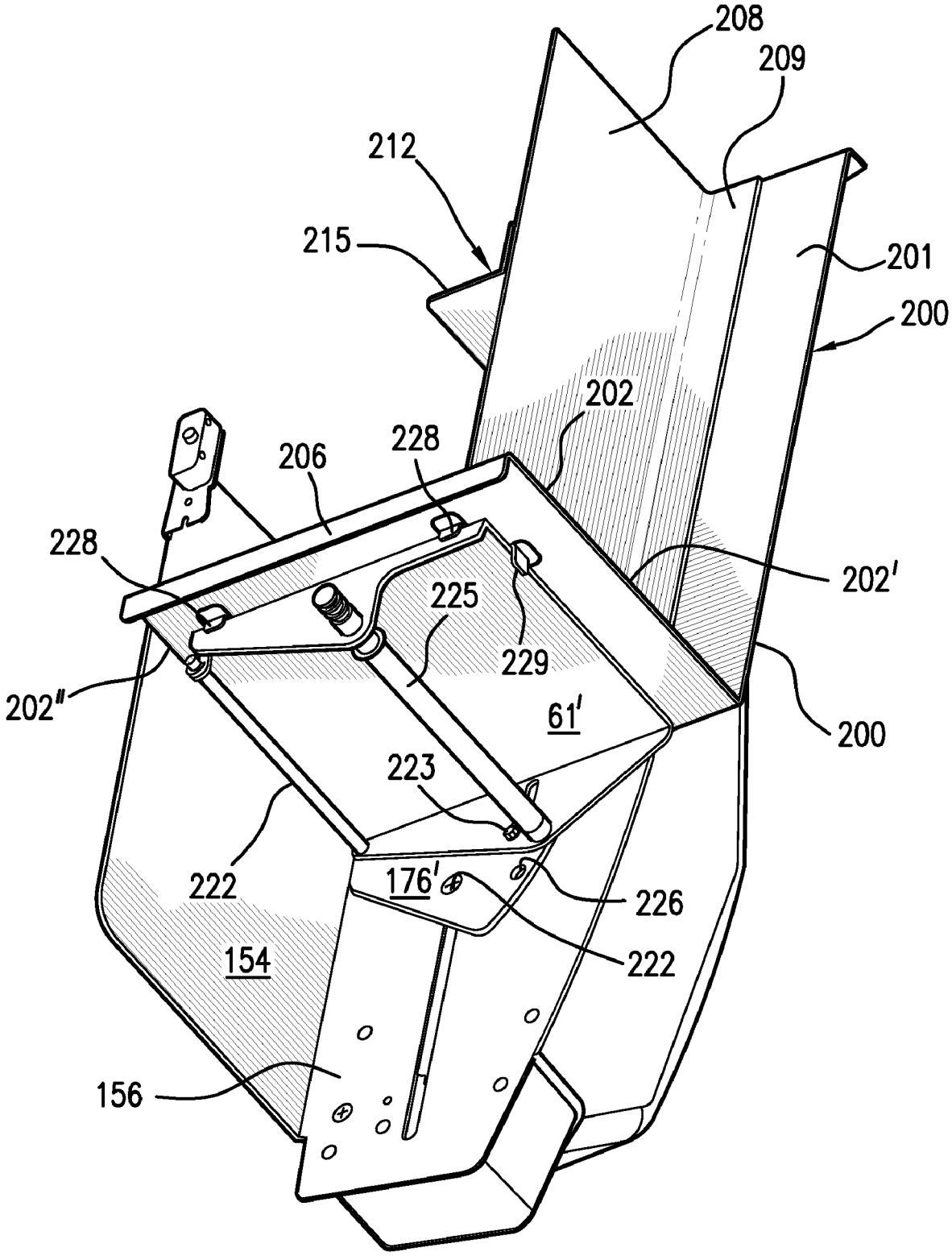
FIG. 3 is a pictorial view showing a platform of the stacker supporting the stack tray.

FIG. 3 shows slightly different version of the platform than the platform 61 shown in FIGS. 1 and 2 and accordingly it is indicated at 61'. The angle of the platform 61' is adjustable about a post or pivot 222. The pivot is secured in a plate 176' like the plate 176. A spring-urged plunger 225 can be pulled outwardly and positioned in one of several holes 226, (only one of which is shown) to adjust the angle of inclination of the platform 61'.

As best shown in FIG. 3, the bottom panel 202 of the stack tray 200 has two spaced apart bent-down tabs 228 at the front adjacent the flange 206, and one bent-down tab 229 adjacent an end 202' of the bottom panel 202. The tabs 228 and 229, referred to generally as "locators", assist in locating the bottom panel 202 and hence the tray 200 on and with respect to the platform 61 or 61'. When thus located, the side edge 202" terminates short of the side wall 154 so as not to rub on the side wall 154 as the platform 61 or 61' moves up or down. Likewise, the rear panel 201 terminates short of the rear wall 156 of the stacker 51 so that the rear panel 201 cannot rub on any part of the rear wall 156.

While a magnet 218 is shown attached to the front panel 213 and a magnet 220 is attached to the rear panel 214 as is preferred, only the side 213 panel or only the rear panel 214 needs to be equipped with a magnet to hold the stack tray 212 in the selected position. It is apparent that the magnets 210 and 220 require that the rear panel or at least a part thereof be comprised of magnetizable or magnetically responsive material, such as steel. Likewise, it is apparent that the magnet 218 requires that the front panel or at least a part thereof be comprised of magnetizable or magnetically responsive material, such as steel.

While the platforms 61 and 61' are disclosed as being movable, the stack tray 200 is also useful with a stacker having a fixed platform.

Figure 9:
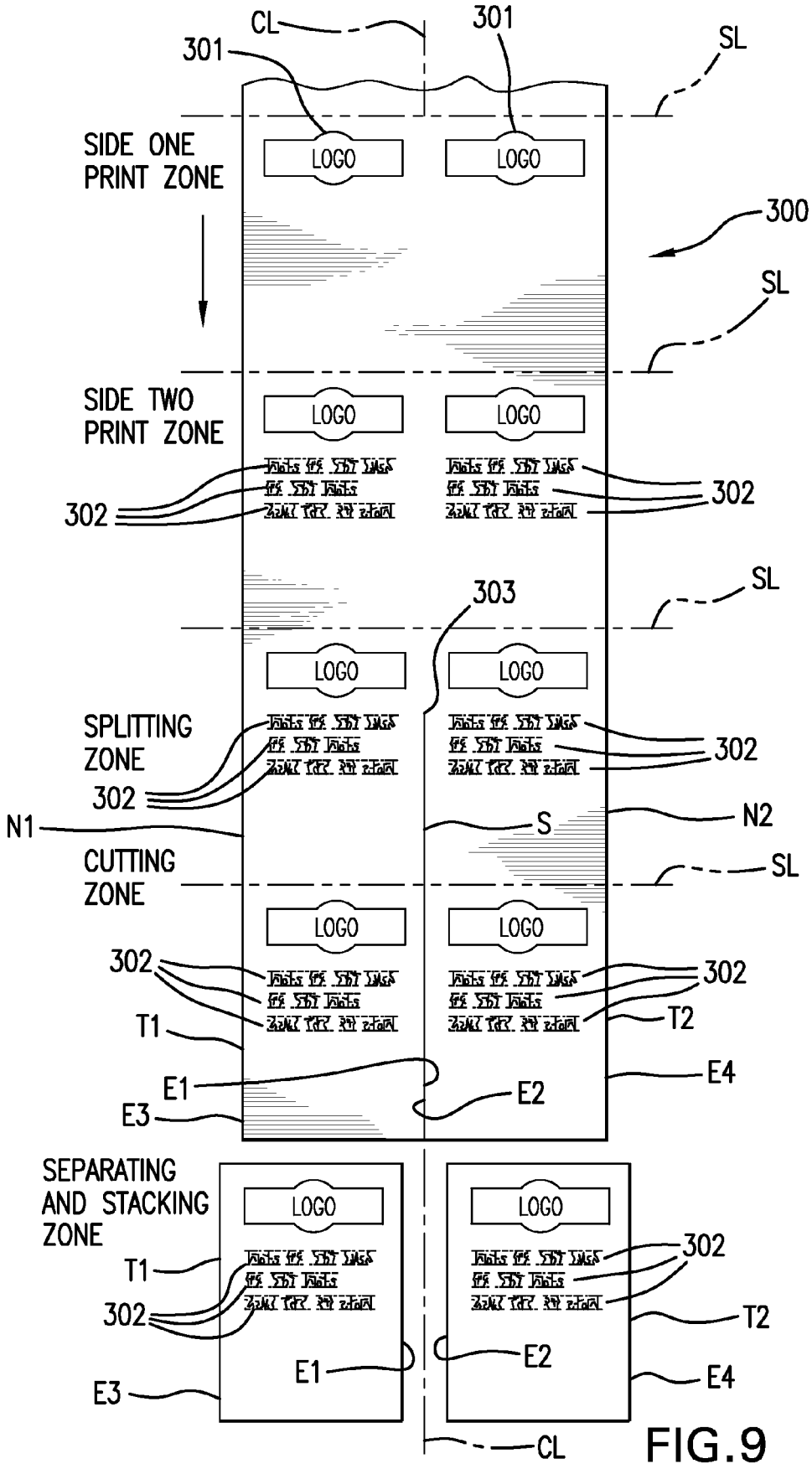
FIG. 9 is a sequential view of a pre-printed wide tag web formed into narrow tag webs, cut into tags and separated and stacked into two spaced apart tag stacks.

With reference to FIG. 9, there is shown a longitudinally extending wide tag web 300 which is wide enough to form a plurality of tags across the width of the wide tag web 300. The wide tag web can be comprised of a variety of different materials as described above. In the illustrated embodiments, the wide tag web is preferably just wide enough to form two series of side-by-side tags T1 and T2. The wide tag web 300 can be separated into tags T1 and T2 by completely severing or cutting along preferably equally spaced severing lines SL. It is thus, apparent that the tags T are of equal length. The wide tag web 300 may carry pre-printing with fixed information such as a logo registration marks (not shown) repetitively laterally across the wide tag web 300. The wide tag web 300 can also carry registration marks (not shown).

The print head 53' (FIG. 1) can be used to print information (not visible in FIG. 9) repetitively across the wide tag web 300 on one face, namely, the underside, of the wide web 300 at zone designated SIDE ONE PRINT ZONE (FIG. 9). In particular, preferably the same information can be printed on both sides of the centerline CL on the underside of the web 300. Likewise, the print head 55' can be used preferably to print the same information 302 on both sides of the centerline CL at zone designated SIDE TWO PRINT ZONE. If the tags T1 and T2 are garment tags, they can bear the usual information such as size, style, color, care instructions, warranty statements, graphics, bar codes and the like.

Next the wide tag web 300 can be slit longitudinally along the centerline CL at a SLITTING ZONE starting at 303 to provide narrow tag webs N1 and N2. The narrow tag webs N1 and N2 can be cut simultaneously by a suitable wide cutter 59 (for example FIGS. 10 and 20) along severing line SL at a zone designated CUTTING ZONE to provide side-by-side tags T1 and T2. As the tags T1 and T2 are dispensed, the tags T1 and T2 are separated and descend gravitationally into two separate stacks S1 and S2 in the stacker 51 as depicted for example in FIGS. 10 and 11.

Figure 10:
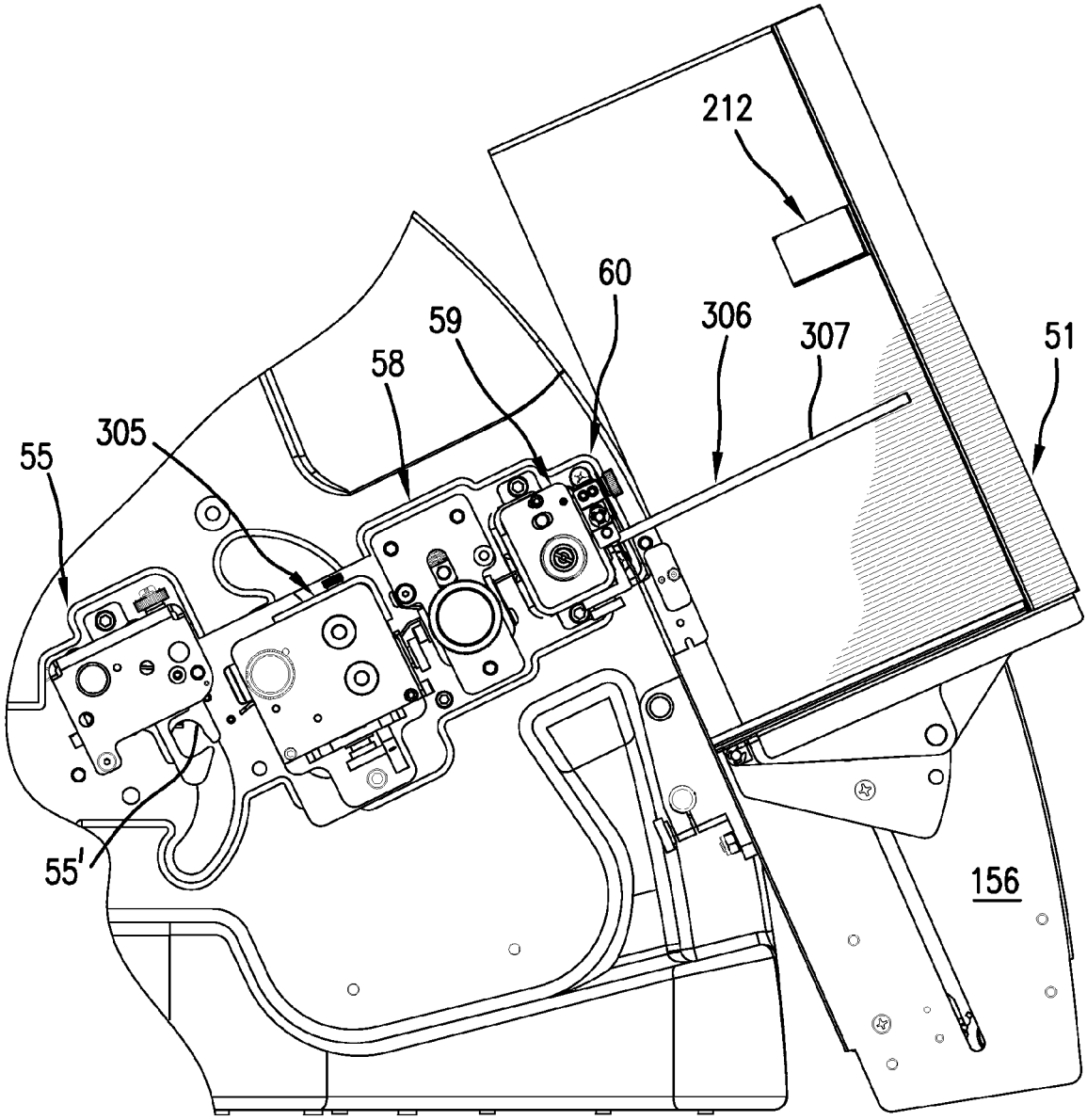
FIG. 10 is a front elevational view of a fragment of the disclosed apparatus showing a printing zone, a slitting zone, a cutting zone, web and tag feeding zones and a stacking zone.
Figure 11:
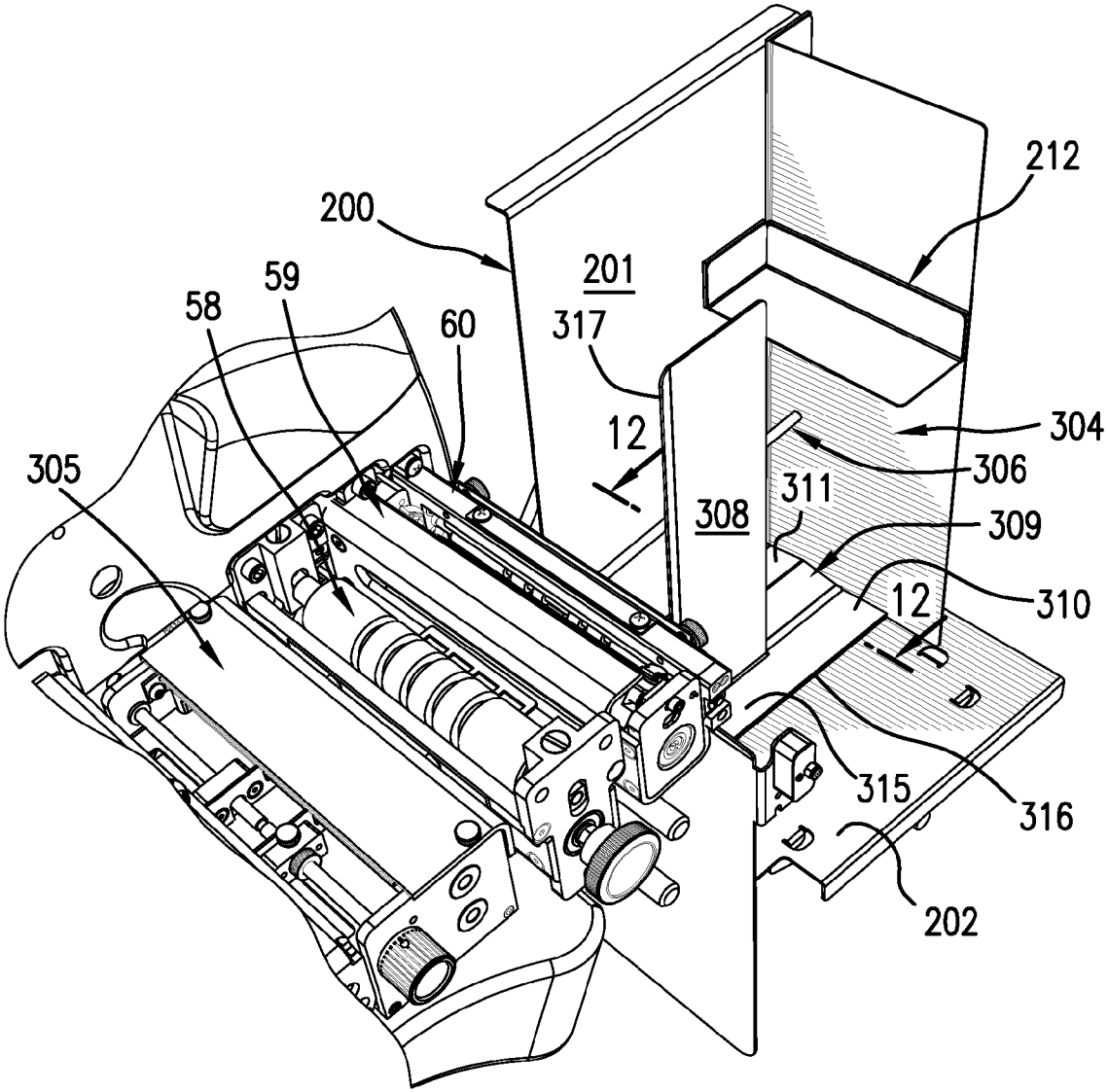
FIG. 11 is a pictorial view of a fragment of the disclosed apparatus showing the zones depicted in FIG. 10.
Figure 12:
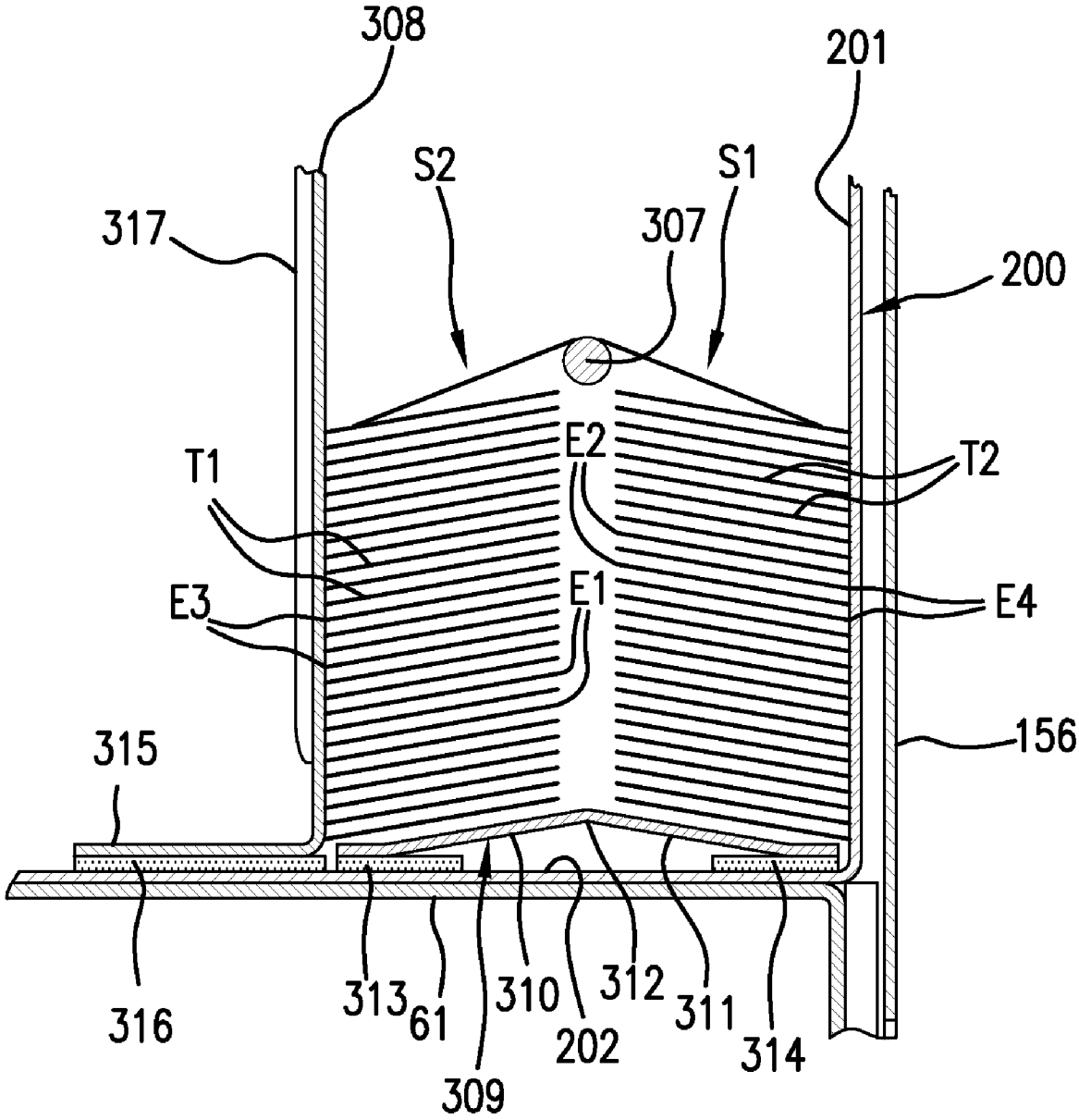
FIG. 12 is a sectional view taken generally along line 12-12 of FIG. 11, but showing two separated tag stacks supported by supports that support the tag stacks inclined away from each other.
Figure 13:
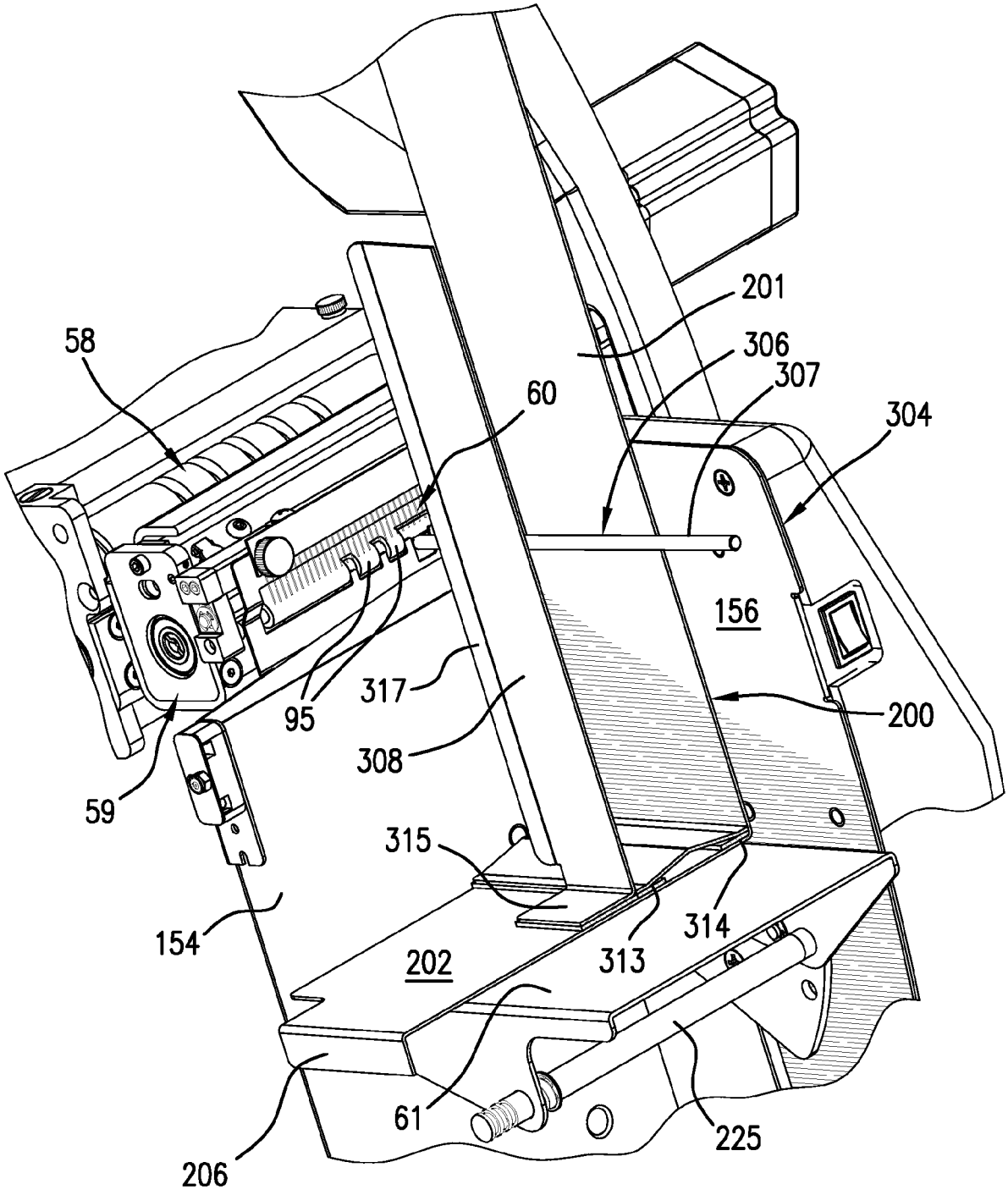
FIG. 13 is a pictorial view of a fragment of the disclosed apparatus showing portions of the stacker tray cutaway.

With reference to FIG. 10, the print head assembly 55 is upstream of a slitter 305. The slitter 305 is disposed adjacent and between the print head assembly 55 and the feed mechanism 58. As in the other embodiment, the cutter or cutter mechanism 59 is downstream of the feed mechanism 58, and the feed mechanism 60 is downstream of the cutter 59. A separator 306 is preferably adjustably cantilever-mounted to the cutter mechanism 59. The wide tag web 300 passes from printing contact with the print head 55' to the slitter 305 where the wide web 300 is slit into the narrow tag webs N1 and N2 at 303. From there the feed mechanism 58 advances the narrow tag webs N1 and N2 to the cutter 59. The tags T1 and T2 which have been cut off by the cutter 59 are fed by the feed mechanism 60 over the separator 306 and are cammed apart to positions best shown in FIGS. 12 and 14. The separator 306 can simply comprise a cantilevered separator rod or separator bar 307 which projects into the stacker 51. The separator bar 307 can have a slotted mounting bracket (not shown) retained by a thumb screw (not shown) so that the separator bar 307 can be slightly adjusted to match the centerline CL. Thus, the centerline of the separator bar 307 is aligned with the centerline CL. The separator 306 and, indeed, the separator rod 307 extend along the centerline of the printer 50, that is, the separator 306 is in center-justified alignment with the centerline of the roll R, the print heads 53' and 55' and the slitter 305. As the narrow tag webs N1 and N2 are advanced into the stacker 51, respective margins at inner edges E1 and E2 extend along the centerline of the separator 306. The remainders of the tags T1 and T2 are unsupported and immediately descend gravitationally and settle onto the top of the respective tag stacks S1 and S2. As the tags T1 and T2 descend, the tag T1 and T2 are cammed outwardly by the separator 306, for example, against respective front wall 308 and rear wall 201. While the separator 306 helps to separate the tags T1 and T2 as they enter the stacker 51, the tags T1 and T2 are supported in such a way as to cause the tags T1 and T2 to accumulate in the stacker 304 in spaced apart tag stacks S1 and S2. Thus, the inclinations of the topmost tag in each stack S1 and S2 helps to cam incoming tags into position against respective front wall 308 and rear wall 201. As best shown in FIG. 12, the tag stacks S1 and S2 are supported on a base or support structure 309 which can simply be comprised essentially of one bent piece of sheet metal, as shown. The support structure 309 includes two downwardly and outwardly incline supports 310 and 311 which meet at an apex 312. As the tags T1 and T2 enter the stacker 304 and fall gravitationally onto the tops of their respective stacks S1 and S2, there is a tendency for the tags T1 and T2 to slid down the immediately respective underlying tags T1 and T2 until their respective outer edges E3 and E4 contact the respective walls 308 and 201. The stacks S1 and S2 are stably supported against supports 310 and 311 and the walls 308 and 201 contribute to maintenance of the stacks in their upright positions. It is the tags T1 and T2 within the stacks S1 and S2 that are inclined while the stacks S1 and S2 remain upright as depicted in FIGS. 12 and 14.

It should be noted that the separator 306 is located in a fixed position. The stacker 51 has its own rear wall 156 which can move laterally by sliding the stacker 51 on shafts 151 and 152. Yet the stacker can accommodate tags T1 and T2 of different widths. The wall 201 of the tray 200 can be against the rear wall 156. This represents essentially the maximum width of the tags T2 that can accumulate. However, the wall 201 of the tray can be positioned forwardly of the wall 156 (as shown in FIG. 12) to accommodate tags T2 of narrower widths. As also shown, the tags T1 and T2 can overhang their respective supports 310 and 311 to a small extent as shown or to a larger extent for wider tags. The support structure 309 is repositionable laterally of the stacker 51 to accommodate tags T1 and T2 of different widths. There are two magnetic strips 313 and 314 which extend lengthwise of the support structure 309 to hold the support structure 309 repositionably to the bottom panel 202 of the magnetizable holder 200. As shown in FIGS. 11 through 14, the wall 308 includes a flange 315 which gives stability to the wall 308. The flange 315 preferably has a magnetic strip 316 attached to its underside to hold the wall 308 repositionably to the bottom panel 202 of the holder 200. The front wall 308 has a forwardly flared flange 317 which strengthens the wall 308 and aids in guiding the tags T1 into the stacker 51.

Figure 14:
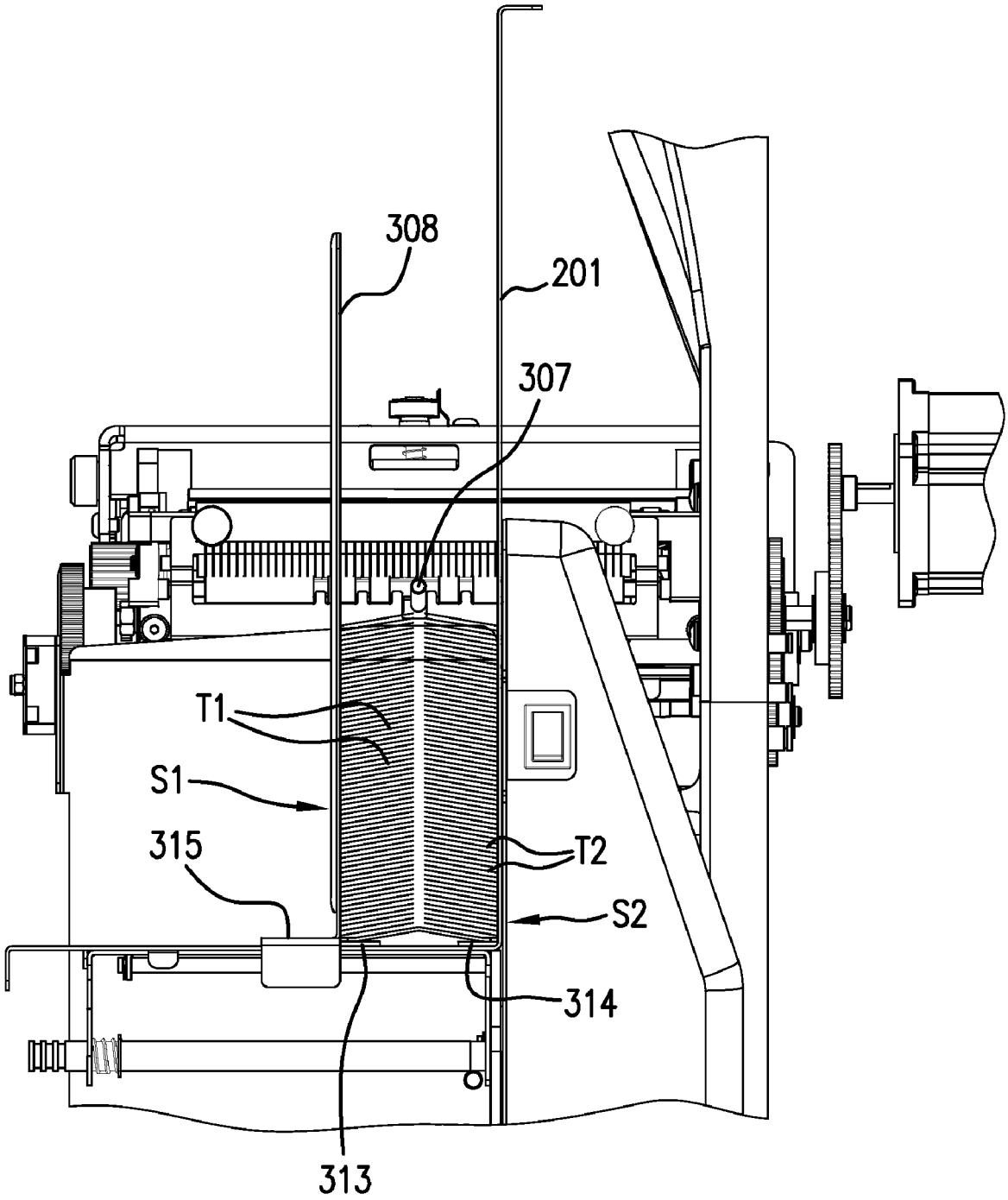
FIG. 14 is a right side elevational view of the apparatus showing tags in separated tag stacks.

With reference to FIG. 14, the line of complete severing S lines up with the top-center of the separator bar 307 as the tags T1 and T2 enter the zone of the stacker 51. The separator bar 307 is shown to be round but it can have other shapes and/or profiles. Also, the separator bar 307 is shown to be inclined upwardly and forwardly to facilitate tag separation. As the tags T1 and T2 slid along and are supported at margins of their adjacent edges E1 and E2 by the separator bar 307, the remainder of the tags T1 and T2 pivot downwardly about the separator bar 307 and fall gravitationally onto either of supports 310 or 311 if there is no tag in the stacker 51 or onto the tops of the existing tag stacks S1 and S2. It is to be understood when the stacker 51 is empty, the stacker platform 61 is in its raised position so the tags T1 and T2 do not descend very far until they are supported by the supports 310 and 311. As the stacks S1 and S2 build, the platform 61 and hence the tray 200 are gradually lowered to maintain the tops of the stacks 51 and 52 at a relatively constant distance, as when the stacker is empty. It is also seen that the separator bar 307 causes the tags T1 and T2 to separate as depicted in FIGS. 12 and 14.

Figure 15:
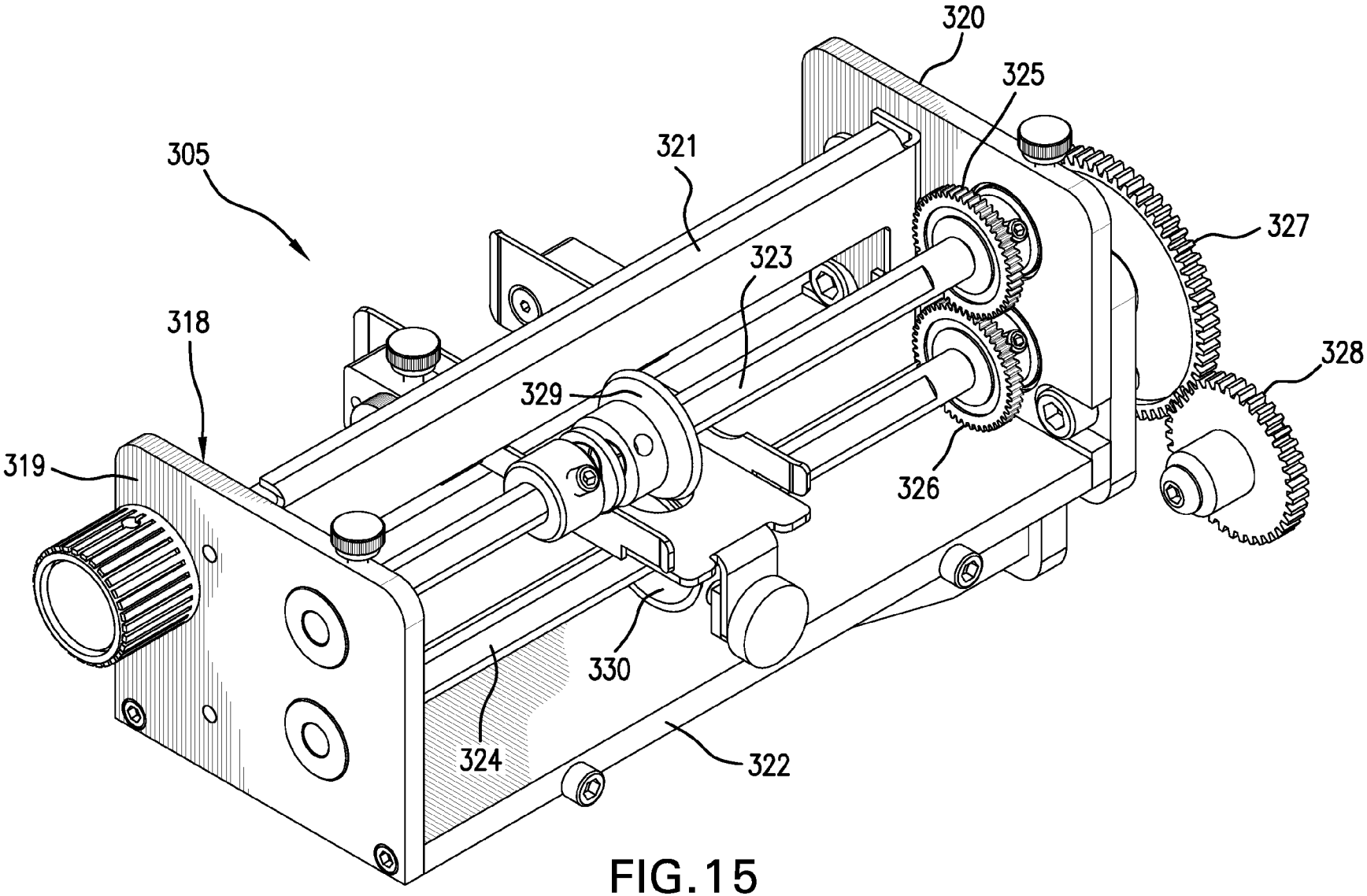
FIG. 15 is a pictorial view of a slitter which can be disposed at the slitting zone.
Figure 16:
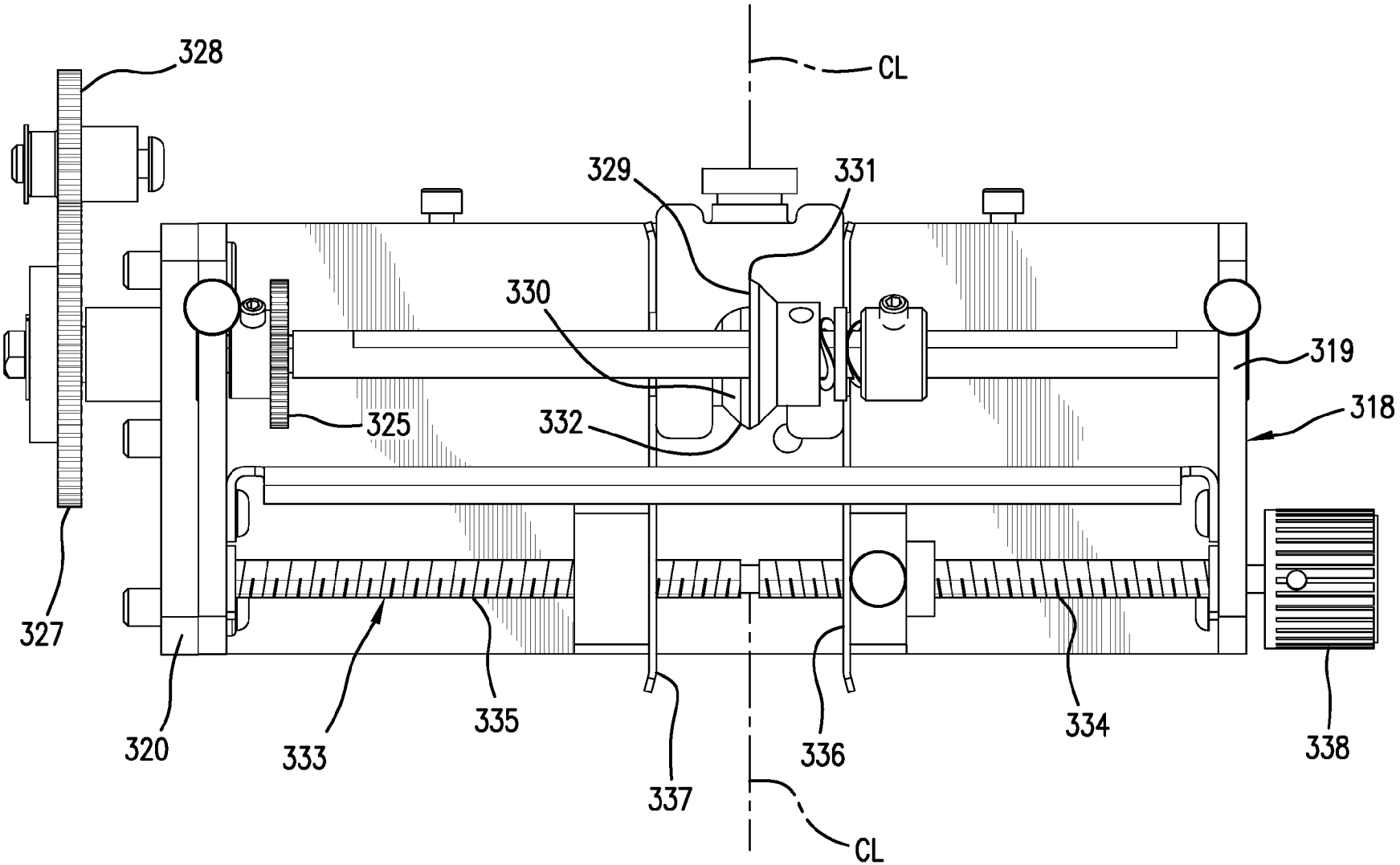
FIG. 16 is a top plan view of the slitter also shown for example in FIG. 15.

FIGS. 15 and 16 show the slitter 305 in greater detail than in FIG. 10. The slitter 305 is shown to comprise a frame generally indicated at 318 with end plates 319 and 320 joined by lateral supports 321 and 322. The slitter frame 318 can be bolted to the printer frame 70. The frame plates 319 and 320 rotatably mount slitter shafts 323 and 324 to which meshing gears 325 and 326 are secured. The gear 326 is driven by a gear 327 which meshes with an idler gear 328. The shafts 323 and 324 have annular slitter blades 329 and 330 secured thereto. As best shown in FIG. 16, the slitter blade 329 is sharpened to a continuous annular edge 331 and the slitter blade 330 is sharpened to a continuous annular edge 332. The edges 331 and 332 are preferably in edge-to-edge contact to cause the wide web 300 to be slit as indicated at S (FIG. 9). As best shown in FIG. 16, the end plates 319 and 320 rotatably mount a threaded shaft 333 having oppositely threaded portions 334 and 335. The threaded portion 334 can, for example, be a left-hand threaded portion 334 and the threaded portion 335 can be a right-hand threaded portion. The portion 334 threadably mounts a non-rotatable guide 336 and the portion 335 threadably mounts a non-rotatable guide 337. A knob 338 on the shaft 333 can be used to adjust for wide webs 300 of different widths.

Figure 17:
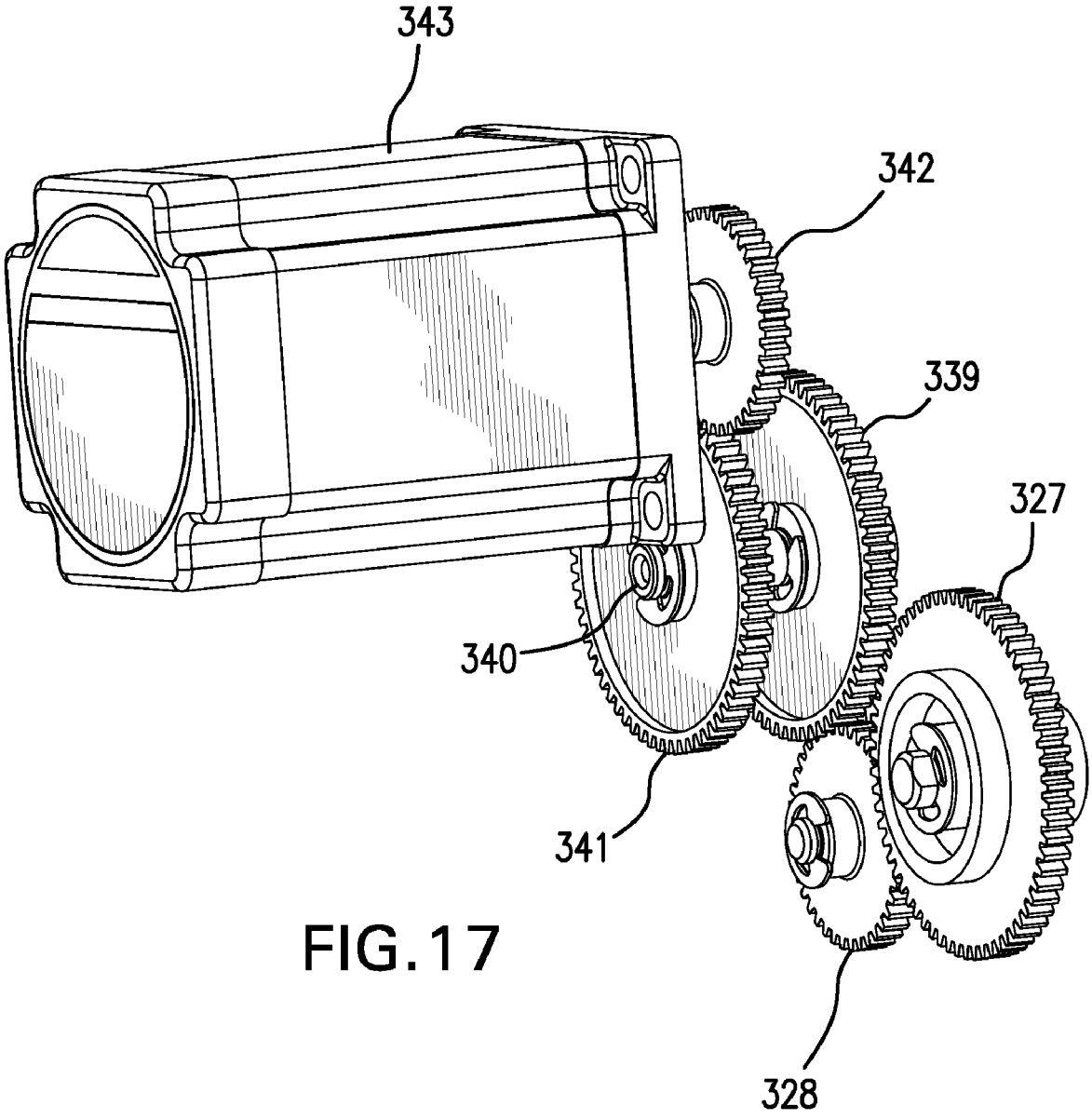
FIG. 17 is a pictorial view of the drive mechanism for the feed mechanism and the slitter.

FIG. 17 shows the gear 328 as meshing with a gear 339 which is secured on a common shaft 340 for rotation as a unit with a gear 341. The gear 341 is driven by a gear 342 which in turn is driven by a motor 343.

Figure 18:
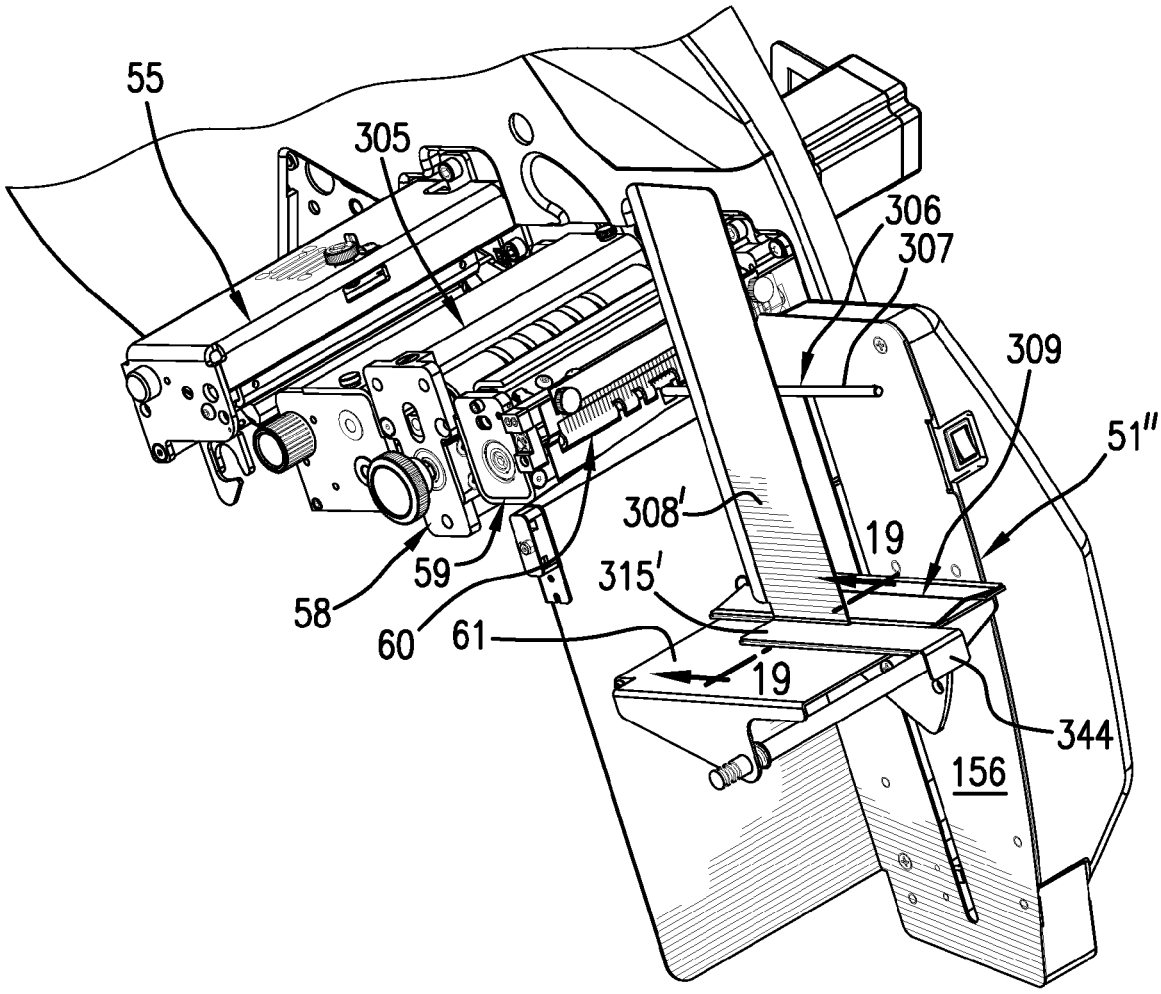
FIG. 18 is a pictorial view depicting an alternative arrangement for supporting tag stacks in the stacker.
Figure 19:
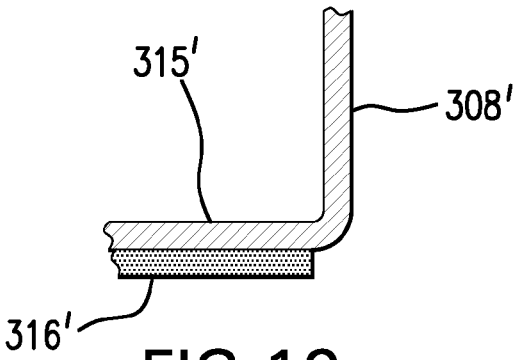
FIG. 19 is a sectional view taken along line 19-19 of FIG. 18.
Figure 20:
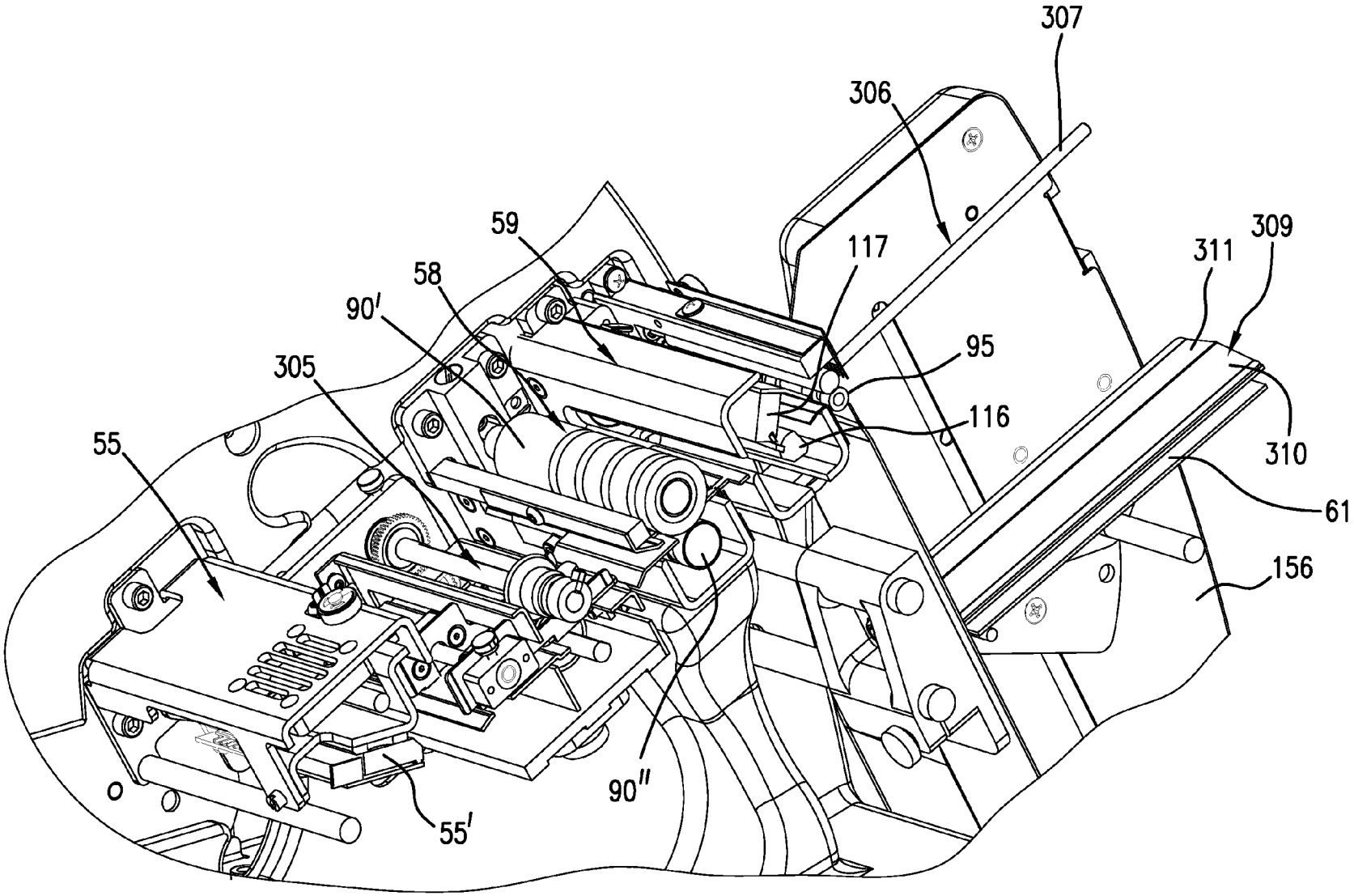
FIG. 20 is a pictorial view of the embodiment of FIGS. 18 through 20 with additional details of the printing, slitting, feeding, cutting and tag advancing mechanisms.

FIGS. 18 through 20 show the stacker 51 with a different arrangement of supporting and side guiding than in FIGS. 10 through 14. The stacker 51 includes the support structure 309 magnetically adhered directly to the platform 61 which is comprised of magnetizable material. A wall 308' is like the wall 308 and a base 315' is like the base 315. A magnetic strip 316 is adhered to the underside of the base 315'. The base 315' extends forwardly and terminates at a downwardly extending flange or handle 344. The arrangement shown in FIG. 18 is intended to accumulate tags as in the embodiment of FIGS. 10 through 17, except the user can reach in and lift the stacks S1 and S2 out of the stacker 51. As shown, the wall 156 of the stacker 51 provides a side edge guide or stop for tags T2 as the tags T2 accumulate in the stack S2, and thereafter.

FIG. 20 omits the wall 308' for clarity. FIG. 20, however, shows the slitter 305, the feed mechanism 58, the cutter 59 and the feed rolls 195 in greater detail.

While the various panels 201, 202, 208, 213, 214, 215, 308, 308', 315 and 315' are illustrated as being generally rectangular, they can have other shapes.

Other embodiments and modifications of the invention will suggest themselves to those skilled in the art, and all such of these as come within the spirit of this invention are included within its scope as best defined by the appended claims.

I claim:

1. A tag making and stacking system, comprising:

at least one print head capable of printing repetitively across at least one face of a wide tag web, a slitter disposed downstream of the print head and capable of slitting the wide tag web into two separate side-by-side narrow tag webs, a first feed roll disposed downstream of the slitter, a cutter disposed downstream of the first feed roll to sever side-by-side tags from the narrow webs, a stacker, and a second feed roll disposed downstream of the cutter to feed the severed tags into side-by-side stacks in the stacker.

2. A system as defined in claim 1, including a motor-driven unwind for a supply roll of the wide tag web disposed upstream of the print head to maintain web tension.

3. A system as define in claim 1, including a motor-driven platen roll cooperable with one print head.

4. A system as defined in claim 1, including a tray removable supported on the stacker to accumulate and maintain the tag stacks until after the tray is removed.

5. A system as defined in claim 1, wherein the stacker is capable of accumulating stacks of tags having various widths.

6. A system as defined in claim 1, wherein the stacker includes, a platform capable of being lowered and raised, and repositionable front and rear walls extending upwardly from the platform and capable of straddling stacks of different width tags.

7. A system as defined in claim 1, including a separator capable of separating the tags into two spaced apart stacks as the tags enter the stacker.

8. A system as defined in claim 1, including a separator capable of separating the tags into two spaced apart stacks as the tags enter the stacker, the separator including a separator bar which causes the side-by-side tags to be cammed apart as they advance into the stacker.

9. A system as defined in claim 1, including a separator bar generally aligned with the slitter to separate the tags as they enter the stacker and descend onto the tags of their respective stacks to provide separated stacks.

10. A system as defined in claim 1, including a separator capable of separating the tags into two spaced apart stacks as the tags enter the stackers, and a bottom support for each stack that inclines the tags in each stack away from the tags of the adjacent stack.

11. A system as defined in claim 1, including a bottom support for each stack that inclines the tags in each stack away from the tags of the adjacent stack.

12. A tag making and stacking system, comprising:

at least one print head capable of printing repetitively across at least one face of a wide tag web, a slitter disposed downstream of the print head and capable of slitting the wide web into a pair of separate side-by-side narrow tag webs, a cutter disposed downstream of the slitter to sever side-by-side tags from the narrow webs, a stacker to receive the tags, and a separator to facilitate separation of the side-by-side tags into spaced stacks as they accumulate in the stacker.

13. A tag making and stacking system, comprising:

at least one print head capable of printing repetitively across at least one face of a wide tag web, a slitter disposed downstream of the print head and capable of slitting the wide web into a pair of separate side-by-side narrow tag webs, a cutter disposed downstream of the slitter to sever side-by-side tags from the narrow webs, a stacker to receive the tags, and a bottom support for each stack that inclines the tags in each stack away from the tags of the adjacent stack.

14. A system as defined in claim 13, including a separator to facilitate separation of the side-by-side tags as they enter the stacker.

15. A tag making and stacking system, comprising:

a print head capable of printing the same information laterally across a longitudinally extending wide web of tag stock on both sides of a longitudinal centerline of the wide tag web, a slitter capable of slitting the wide tag web along the centerline into a pair of completely severed narrow tag webs, a cutter capable of cutting the narrow tag webs laterally into side-by-side tags, and a separator to separate the side-by-side tags laterally while allowing the separated tags to descend gravitationally to form two spaced apart tag stacks.

16. A system as defined in claim 15, including a support for each stack of tags, the supports being effective to cause the tags of both stacks to be inclined away from each other.

17. A system as defined in claim 15, including spaced walls providing a tag stack accumulating space, a support for each stack of tags, the supports being oppositely inclined so that the stacks of tags are inclined away from each other and each stack is confined by one of the walls.

18. Method, comprising:

printing the same information laterally across a longitudinally extending wide tag web of tag stock on both sides of a longitudinal centerline of the wide tag web, slitting the wide tag web along the centerline into a pair of completely severed narrow tag webs, cutting the narrow tag webs laterally into side-by-side tags, and separating the side-by-side tags laterally and allowing the separated tags to descend gravitationally to form two spaced apart tag stacks.

* * * * *